US005926077A

United States Patent [19]

Milroy

[11] Patent Number: 5,926,077

[45] Date of Patent: Jul. 20, 1999

[54] COMPACT, ULTRAWIDEBAND MATCHED E-PLANE POWER DIVIDER

[75] Inventor: William W. Milroy, Playa del Rey, Calif.

[73] Assignee: Raytheon Company, Lexington, Mass.

[21] Appl. No.: 08/884,837

[22] Filed: Jun. 30, 1997

[51] Int. Cl.[6] ..... H01P 5/12

[52] U.S. Cl. ..... 333/125; 333/137

[58] Field of Search ..... 333/125, 137

[56] References Cited

FOREIGN PATENT DOCUMENTS 672685 7/1979 U.S.S.R. ..... 333/125

OTHER PUBLICATIONS

Griemsmann et al., "Broad–Band Waveguide Series T for Switching," IRE Transactions on Microwave Theory and Techniques, pp. 252–255, Oct. 1956.

Ishimaru, Electromagnetic Wave Propagation, Radiation, and Scattering, Prentice–Hall, Englewood Cliffs, NJ, pp. 88 & 93, 1991.

*Primary Examiner*—Robert Pascal

*Assistant Examiner*—Justin P. Bettendorf

*Attorney, Agent, or Firm*—Leonard A. Alkov; Glenn H. Lenzen, Jr.

[57] ABSTRACT

Power dividing apparatus comprising a T-junction and an E-plane step transformer having a phase slope equal and opposite to the phase slope of the T-junction, so that the overall phase slope through the T-junction and E-plane step transformer is minimized over a wide range of frequencies.

4 Claims, 2 Drawing Sheets

COMPACT, ULTRAWIDEBAND MATCHED E-PLANE POWER DIVIDER

BACKGROUND

The present invention relates generally to power dividers, and more particularly, to a compact, ultrawideband matched E-plane power divider.

In order to achieve wide instantaneous bandwidth, transmission lines and other components of a corporate feed must be nondispersive, in that they must have negligible phase variations as a function of frequency. Parallel-plate waveguide is a TEM transmission line, and is nondispersive. Over-moded rectangular waveguide normally operates far from cutoff, so it is essentially nondispersive except at very low frequencies. Conventional E-plane bends, however, are dispersive due to the reactive characteristic of the T-junction.

The performance of E-plane T-junctions in conventional rectangular waveguide operating in the dominant $TE_{1,0}$ mode is described extensively in the literature. For example, see C. G. Montgomery, R. H. Dicke and E. M. Purcell (eds.), "Principles of Microwave Circuits" (MIT Radiation Lab. Ser. No. 8), pg. 285, McGraw-Hill, New York, 1951, N. Marcuvitz (ed.), "Waveguide Handbook" (MIT Radiation Lab. Ser. No. 10), pp. 336–350, McGraw-Hill, New York, 1951, and T. Moreno, "Microwave Transmission Design Data", pp. 157–161, Artech House, Norwood, Mass., 1989.

Qualitatively, similar performance is obtained for E-plane T-junctions that operate in the TEM mode in parallel-plate waveguide, or if the sides are bounded by conducting walls, in the $TE_{m,0}$ modes. Each of these junctions has a reactive component that produces a phase slope, or variations in the reflection and transmission phases, with changes in frequency. A tuning element such as a post or iris is typically used to cancel out the reactive component of the junction; however, due to the dispersive characteristic of the $TE_{1,0}$ mode in rectangular waveguide, exact cancellation occurs at only one frequency with a residual phase slope elsewhere.

Accordingly, it is an objective of the present invention to provide for a compact, ultrawideband matched E-plane power divider.

SUMMARY OF THE INVENTION

It is well known that a linear, passive, lossless T-junction cannot be matched completely. However, to meet the above and other objectives, the present invention provides for a power divider formed as a waveguide comprising a T-junction with first, second and third ports 12*a*, 12*b*, 12*c*, and comprising an E-plane step transformer formed between the first, second and third ports 12*a*, 12*b*, 12*c*. The E-plane step transformer has a phase slope equal and opposite to the phase slope of the T-junction, so that the overall phase slope through the T-junction and E-plane step transformer is minimized over a wide range of frequencies.

The present invention thus provides for a design methodology whereby the amplitude and phase of the reflection coefficient ($S_{11}$) of one port of an E-plane T-junction can be well-matched over an extremely wide range of frequencies. The E-plane step transformer is used to offset the variation in insertion phase ($S_{12}$) with frequency that arises from the reactive characteristic of the T-junction. Although the concept is best exploited in parallel-plate waveguide (TEM mode) or in over-moded rectangular waveguide ($TE_{m,0}$ modes), it can also be advantageously used in conventional rectangular waveguide ($TE_{1,0}$ mode).

The matched E-plane power divider was developed as a component for a true-time-delay corporate feed of a continuous transverse stub array antenna developed by the assignee of the present invention. With one port as an input port, power is divided between the two remaining arms in direct proportion to their height ratio, that is b/b', where b is the height of each arm of each step transition of the step transformer and b' is the height of the ports of the T-junction. Due to the simple relationship between waveguide height and impedance level, the n-stage, multilevel step transformer design methodology is easily implemented. The reflection coefficient of the matched port remains fairly constant over a wide range of frequencies, and therefore it presents a well-behaved microwave interface to a radiating aperture of an antenna.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which.

DETAILED DESCRIPTION

Figure 1A:
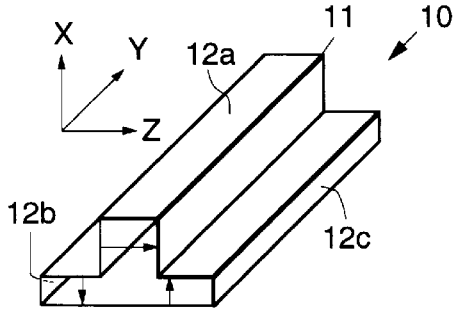
FIG. 1a (PRIOR ART)
FIG. 1*a* illustrates an isometric view of a conventional unmatched E-plane T-junction in parallel-plate waveguide
Figure 1B:
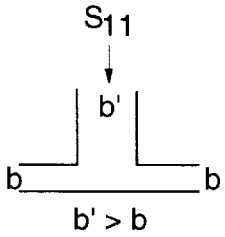
FIG. 1b (PRIOR ART)
FIG. 1*b* illustrates cross-sectional view of the unmatched junction shown in FIG. 1*a;*
Figure 1C:
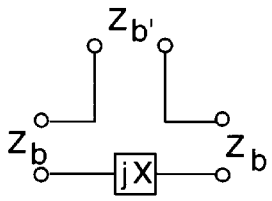
FIG. 1c (PRIOR ART)
FIG. 1*c* illustrates a simplified equivalent circuit of the unmatched junction shown in FIG. 1*a;*

Referring to the drawing figures, FIG. 1*a* shows an isometric view of a conventional unmatched E-plane T-junction 10 in parallel-plate waveguide 11 having three ports 12*a*, 12*b*, 12*c*. A linear-polarized electric field incident at any port 12*a*, 12*b*, 12*c* will divide out-of-phase between the other two ports 12*a*, 12*b*, 12*c*, and the power split is proportional to the relative height of the arms of the ports 12*a*, 12*b*, 12*c*. FIG. 1*b* shows the first port 12*a* having port height b' designated as an input port, while the second and third ports 12*b*, 12*c* are output ports that are arbitrarily assigned equal heights b, where b'>b. FIG. 1*c* shows a simplified equivalent circuit of the conventional unmatched E-plane T-junction 10, where jX is the lumped junction reactance.

Figure 2A:
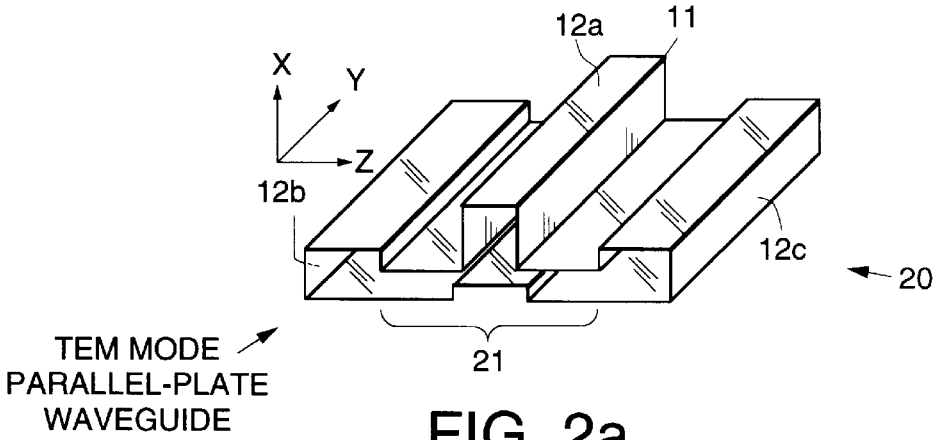
FIG. 2*a* shows an isometric view of an exemplary matched E-plane T-junction in accordance with the principles of the present invention formed in a parallel-plate waveguide.
Figure 2B:
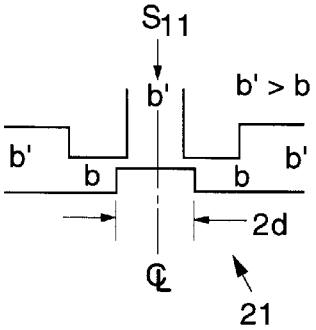
FIG. 2*b* illustrates a cross-sectional view of the matched E-plane T-junction of FIG. 2*a;*
Figure 2C:
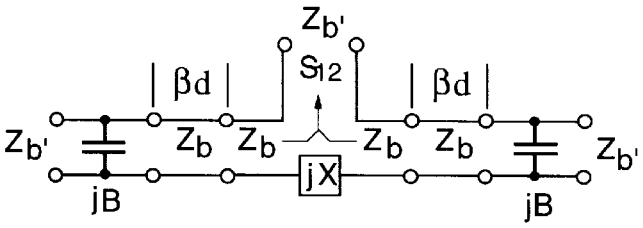
FIG. 2*c* illustrates a simplified equivalent circuit of the matched E-plane T-junction of FIG. 2*a;*

FIG. 2*a* shows an isometric view of an exemplary matched E-plane power divider 20 or T-junction 20 in accordance with the principles of the present invention that is formed in a parallel-plate waveguide 11. A matching multilevel step transformer 21 that transitions from waveguide height b to waveguide port height b' is used to transition between the first, second and third ports 12*a*, 12*b*,

12*c* of the matched E-plane T-junction 20. The step transformer 21 was selected because it can be configured to tune out the junction reactance, and cancel out much of the phase slope over a wide range of frequencies. FIG. 2*b* shows a cross section of the matched E-plane T-junction 20, with the first port 12*a* designated as the input port. FIG. 2*c* shows a simplified equivalent circuit, where jX is the lumped junction reactance, βd is the electrical phase length of the matching step transformer 21, and the shunt capacitance represents the step in waveguide height from b to b'.

Figure 3A:
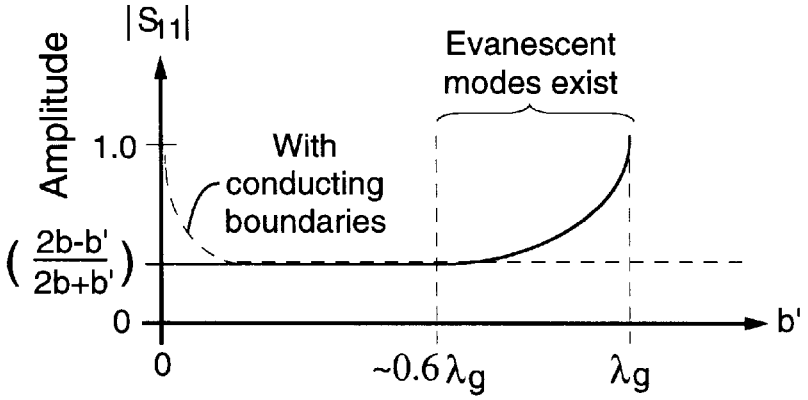
FIG. 3*a* is a graph of reflection coefficient amplitude versus port height b'.
Figure 3B:
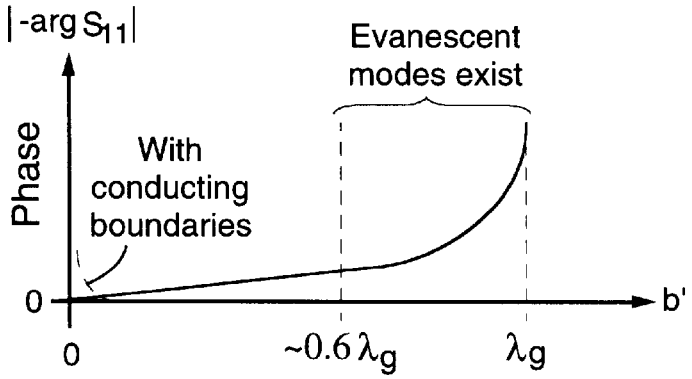
FIG. 3*b* is a graph of reflection coefficient phase versus port height b'.

FIG. 3*a* qualitatively shows that the port height b' can be selected over a wide range of frequencies to minimize variations in amplitude of the reflection coefficient (i.e., where $|S_{1,1}|$ asymptotically approaches the ratio (2b−b')/(2b+b')). For b'>λg, $TE_{m,n}$ modes can propagate, which are highly dispersive. In the region where 0.6 λg>b'>λg, the $TE_{m,n}$ modes cannot propagate, but evanescent modes exist that cause increasingly large reflections as b'/λg approaches unity. The dashed part of the curve in FIG. 3*a* shows the effect of conducting boundaries in the x-z plane, which causes the $TE_{1,0}$ mode to become highly dispersive as it approaches cutoff. Similarly, FIG. 3*b* shows how careful selection of port height b' can avoid the large phase slopes caused by operating too close to cutoff or where evanescent modes begin to proliferate.

Figure 4:
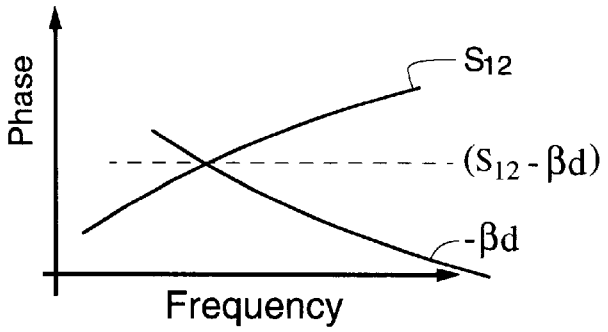
FIG. 4 is a graph that illustrates that the phase slope ($-\beta d$ vs. f) of a step transformer employed in the cancels the insertion phase slope ($S_{12}$ vs. f) of the junction.

FIG. 4 is a graph that illustrates that the phase slope (−βd vs. f) of the matching step transformer 21 used in the matched E-plane T-junction 20 cancels the insertion phase slope ($S_{12}$ vs. f) of the junction 20. FIG. 4 shows qualitatively how the phase of the step-transformer 21, βd, is used to cancel the insertion phase, $S_{12}$, of the junction so that the net phase, $S_{12}$−βd, is kept nearly constant over a wide range of frequencies. When dispersive waveguide 11 is used, the residual phase slope increases as the frequency range increases. For nondispersive parallel-plate waveguide 11, however, the phase slope of the junction can be minimized over a much wider range of frequencies using the multistage, E-plane transformer 21 and methodology described herein.

The matched E-plane power divider may generally be used with waveguide feed networks, filters, multiplexers and antennas such as the true-time-delay continuous transverse stub array antennas. Specifically, the matched E-plane power divider has been designed for use in a continuous transverse stub array antenna that operates over an extended band of 3.5 to 20.0 GHz.

The present invention may also be used with multifunctional military systems or high-production commercial products where a single ultrawideband aperture can replace several narrowband antennas, such as a point-to-point digital radio, or global broadcast satellite, for example. Also, because the cross section of the power divider is invariant in one dimension, the present invention lends itself to inexpensive, high-volume fabrication techniques such as by extrusion or plastic injection molding processes.

Thus, a compact, ultrawideband matched E-plane power divider has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An E-plane power divider characterized by:

a waveguide comprising a T-junction having first, second and third ports, and an E-plane step transformer formed between the first, second and third ports, and wherein the E-plane step transformer has a phase slope equal and opposite to the phase slope of the T-junction, so that the overall phase slope through the T-junction and E-plane step transformer is minimized over a wide range of frequencies.

2. The power divider of claim 1 wherein the waveguide is characterized by a TEM mode parallel-plate waveguide.

3. The power divider of claim 1 wherein the waveguide is characterized by a $TE_{m,0}$ over-moded rectangular waveguide.

4. The power divider of claim 1 wherein the waveguide is characterized by a $TE_{1,0}$ mode rectangular waveguide.

* * * * *